US005844185A

United States Patent [19]

Shih

[11] Patent Number: 5,844,185

[45] Date of Patent: Dec. 1, 1998

[54] MOMENTARY SWITCH

[76] Inventor: Yingtien A. Shih, 24108 Rothbury Dr., Moreno Valley, Calif. 92553

[21] Appl. No.: 944,380

[22] Filed: Oct. 6, 1997

Related U.S. Application Data

[63] Continuation-in-part of Ser. No. 668,479, Jun. 25, 1996, abandoned.

[51] Int. Cl.[6] ..... H01H 15/00; H01H 1/04

[52] U.S. Cl. ..... 200/16 R; 200/16 A; 307/112

[58] Field of Search ..... 200/16 R, 16 A, 200/16 C, 520, 530; 307/112

[56] References Cited

U.S. PATENT DOCUMENTS 3,740,501 6/1973 Kiessling et al. ..... 200/16 R
4,379,973 4/1983 Turner et al. ..... 307/112
4,691,086 9/1987 Habecker et al. ..... 200/16 A
5,408,058 4/1995 Homik et al. ..... 200/16 R

*Primary Examiner*—Peter S. Wong
*Assistant Examiner*—Bao Q. Vu

[57] ABSTRACT

A momentary switch includes a base plate, a switch body having an operation cavity at a predetermined location is mounted on the base plate, a top push-button having a first axial hole centrally provided at a bottom portion thereof, a shuttle which is smaller in size than the operation cavity of the switch body is positioned within the operation cavity, a transport rod has a first end inserted in the first axial hole of the top push-button and a second end inserted in a second axial hole positioned a top portion of the shuttle, a spring loop around the transport rod, and four contact plate for transferring an electrical signal. The momentary switch can eliminated the bouncing problems of traditional push-button switch by providing only two terminals instead of four terminals found in the traditional push-button switch.

14 Claims, 4 Drawing Sheets

MOMENTARY SWITCH

CROSS-REFERENCE TO RELATED APPLICATION

This application is a continuation-in-part application of an original utility patent application, Ser. No. 08/668,479, filed May 25, 1996, now abandoned.

BACKGROUND OF THE INVENTION

1. Field of the Invention

The present invention relates to momentary push-button switch, and more particularly to a momentary switch specifically equipped with counting circuit, computer system or automate control system.

2. Description of the Prior Art

Ever since the first computer system built back in the early 1970's, the computer technology has been improved each minute of each days. The first computer has a size as large as a room, and cost over two millions dollars. But with hard work and continuous new inventions from the computer engineers, now almost every family in the United States has at least a personal computer PC that is affordable to do some magically calculation, drawing, or bookkeeping for the family members.

In the beginning, everything are built so large, that it's not practical for home use. But all computer engineers have one thing in mind which are to make everything simple, compact, economical and yet still does the work of the original invention, if not better. With these types of altitude, the computer world was able to improve so fast, especially during the last five years. The price of the PC also drop as result of the improvement, an example such as a Pentium 90 computer with fully loaded accessory sold for US$2500 back in 1991, but now the same computer would not cost for more than US$500, which is one fifth of the original price.

Since the computer industry moved so fast, most engineers can only try to improve some special field that they are working on. There are one common problem in the computer industry, especially in the digital circuits is to try to locate a pin's position of a large-scale integration (LSI) chip or a very-large-scale integration (VLSI) chip which includes so many pins crowded so closely. The engineers need to count the pins by their naked eyes, and because each pin is positioned so closely, the pins often are miscounted, thus wrong pin is then located.

There are few different types of switches on the market today, such as a conventional momentary push-button switch and a SPDT switches. When the conventional switches working with the RC serial circuit that are connected to pin 2 of a 555 timer of the counting circuit for one-by-one up counting (0 to 99) to locate the position of the pins while working with the IC-pin toucher softly crossing pins, a bounce problem often causes wrong counting, such as jumping from 3 to 5, missing 4 in-between.

The traditional momentary push-button switch has four terminals for allowing the electric current to flow through, as shown in FIG. 1. More terminals would only lead to more bouncing problems. When the momentary push-button switch is pressed down, the switch will bounce back and forth for few times before it stabilized. The bouncing feature of the traditional momentary push-button switch causes influence on the digital circuit and affect the normal functioning of the digital circuit.

SUMMARY OF THE PRESENT INVENTION

The main objective of the present invention is to provide a momentary switch which can eliminate the bouncing problems of traditional push-button switch by providing only two terminals instead of four terminals found in the traditional push-button switch.

Another objective of the present invention is to provide a momentary switch specifically equipped with the 74LS00 debouncer in order to output a bounceless one-shot for accurate one-by-one counting.

Another objective of the present invention is to provide a momentary switch which can be used in full range of electronic appliance such as counter, clock setting, VCR time setting, automatic control, and single-step switch for computer that can have one reaction following by each action.

Accordingly, in order to achieve the above mentioned objects, the momentary switch of the present invention comprises a base plate, a switch body having an operation cavity at a predetermined location is mounted on the base plate, a top push-button having a first axial hole centrally provided at a bottom portion thereof, a shuttle which is smaller in size than the operation cavity of the switch body is positioned within the operation cavity, a transport rod having a first end inserted in the first axial hole of the top push-button and a second end inserted in a second axial hole positioned a top portion of the shuttle, a spring looping around the transport rod, and four contact plates for transferring an electrical signal. The four contact plates includes a first contact plate disposed at a first contact edge of the switch body, a second contact plate disposed at a second contact edge of the shuttle, a third contact plate disposed at a third contact edge of the shuttle, and a fourth contact plate disposed at a fourth contact edge of the switch body. A length of the transport rod is greater than a length of the axial passage plus a length of the shuttle, so that a predetermined distance defined between the third contact plate and the fourth contact plate is equal to a length of the transport rod extended out of a top surface of the switch body. The switch body further has an axial passage coaxially provided therein in respect to the first axial hole of the top push-button and the second axial hole of the shuttle. The transport rod is adjustably inserted in the axial passage of the switch body along with the spring.

DETAILED DESCRIPTION OF THE PREFERRED EMBODIMENT

Figure 1:
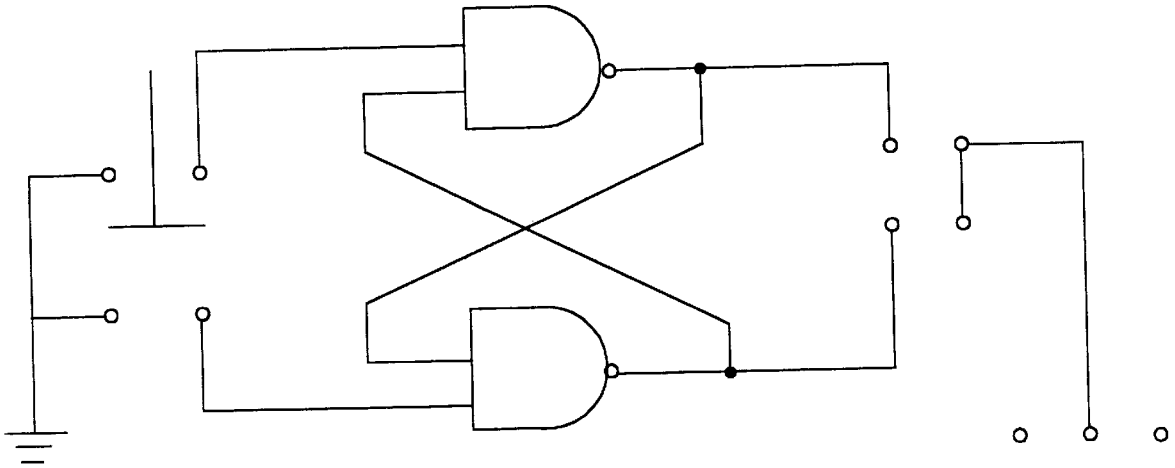
PRIOR ART FIG. 1
FIG. 1 is a diagrammatic electrical circuitry illustrating the four-terminal type conventional momentary push-button switch.
Figure 2:
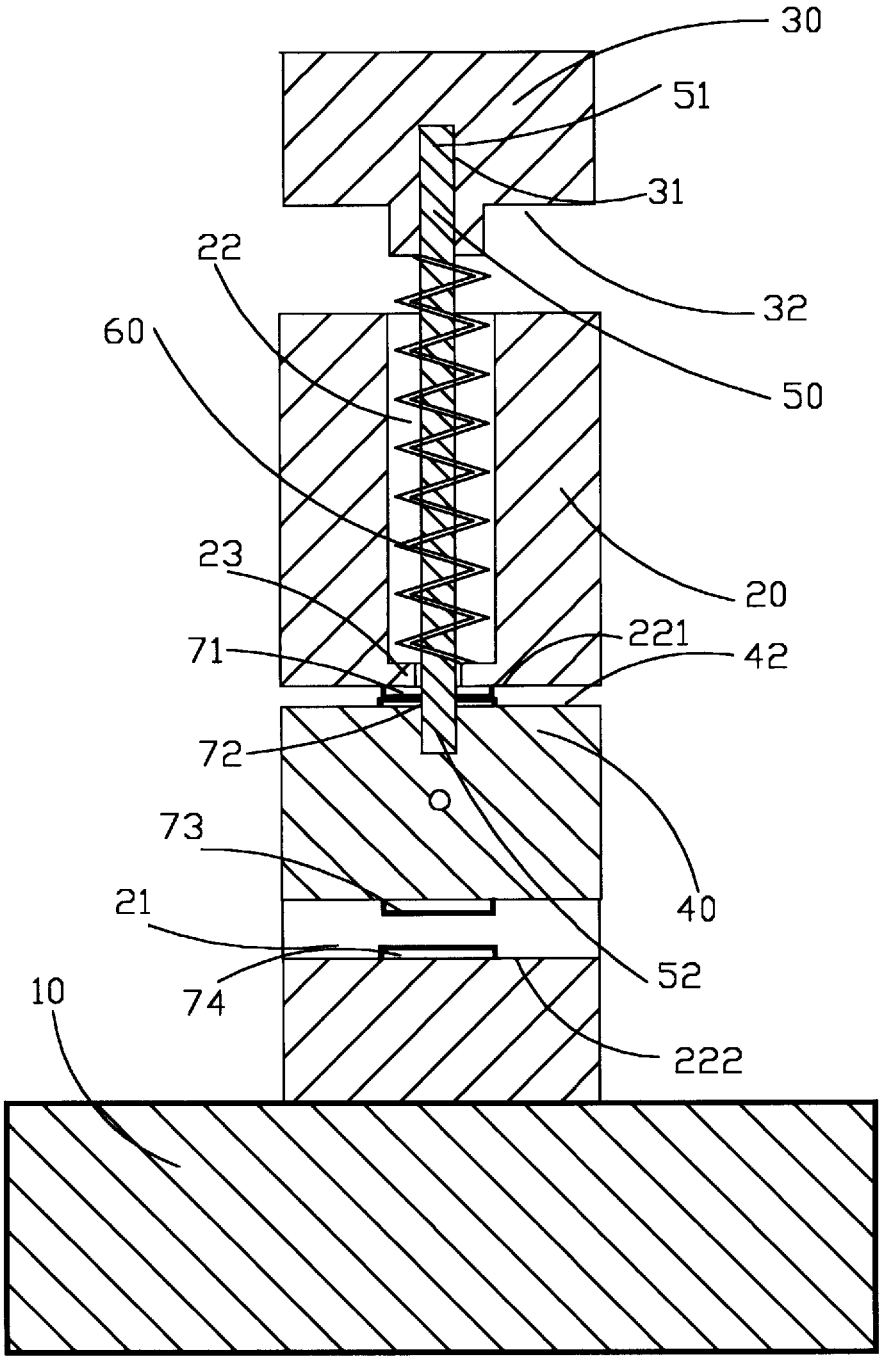
FIG. 2 is a sectional end view along line A–A' of FIG. 4 of a momentary switch according to a preferred embodiment of the present invention.
Figure 3:
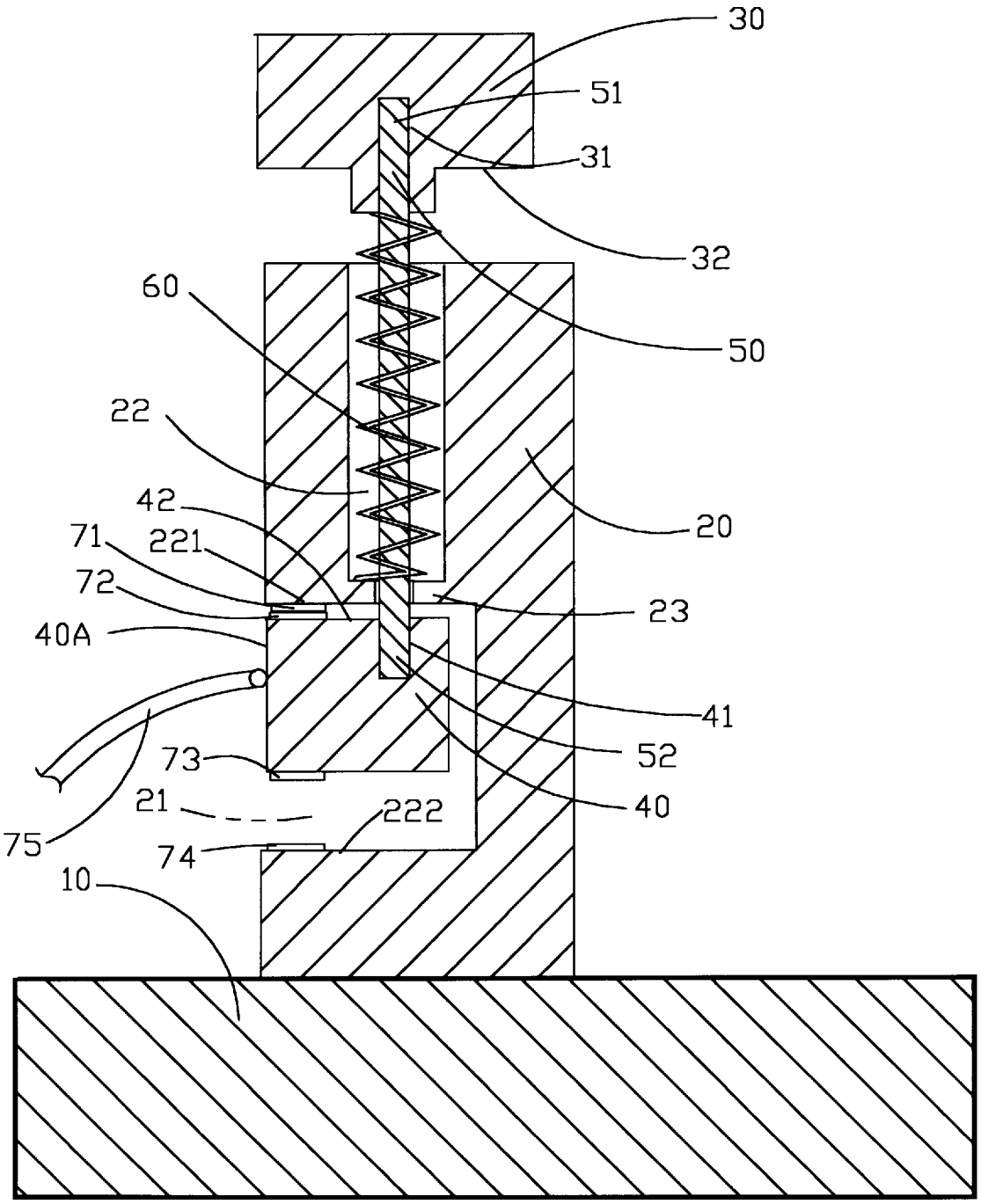
FIG. 3 is a sectional end view alone line B–B' of FIG. 4 of the momentary switch according to the above preferred embodiment of the present invention.
Figure 4:
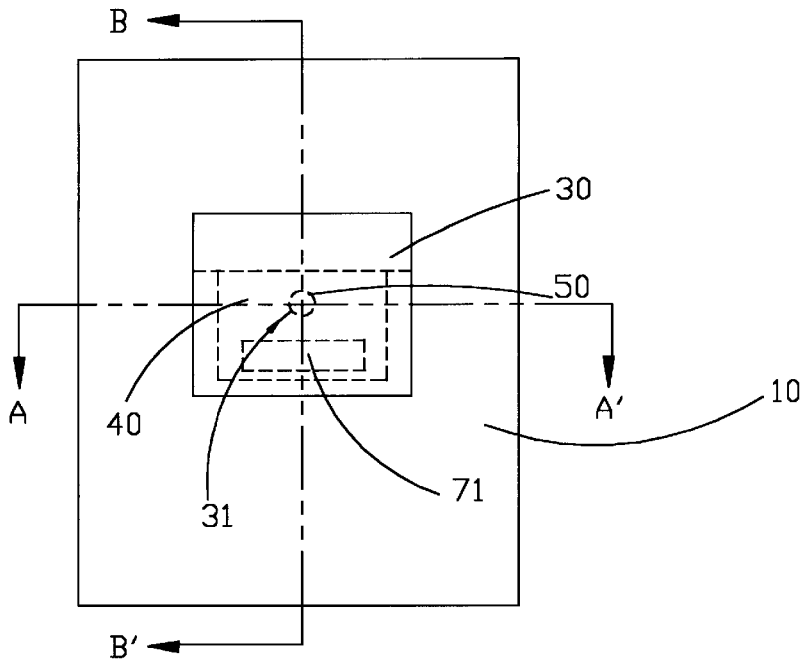
FIG. 4 is a top view of the momentary switch according to the above preferred embodiment of the present invention.

Referring to FIGS. 2 to 4 of the drawings, a momentary switch according to a preferred embodiment of the present invention is illustrated. The momentary switch stands for a single step switch for a computer or automate system, to which when the user pushes the switch once every time, one single operation would be perform according to the preset function for such switch. The momentary switch of the present invention comprises a base plate 10, a switch body 20, a top push-button 30, a shuttle 40, a transport rod 50, and a spring 60.

The switch body 20 is constructed from PVC material or polyurethane plastic material and mounted on the base plate 10. The switch body 20 further has an operation cavity 21 formed at a predetermined position to receive the shuttle 40 therein and an axial passage 22 extended from a top end of the switch body 20 to the operation cavity 21 for receiving the transport rod 50 and the spring 60 therein. In order words, the shuffle 40 which is smaller in size than the operation cavity 21 of the switch body 20 is positioned within the operation cavity 21. The spring 60 is looped around the transport rod. A bottom end of the axial passage 22 reduces its diameter to just slightly larger than the transport rod 50 to form a shoulder rim 23.

The transport rod 50, which is adjustably inserted in the axial passage of the switch body 20 along with the spring 60, has a first end 51 extended upwardly out of the top end of the switch body 20 to connect with the top push-button 30 and a second end 52 extended downwardly into the operation cavity 21 to connect with the shuttle 40. The spring 60 is extended between the top push-button 30 and the shoulder rim 23 so as to upwardly press the shuttle 40 to remain in an upper normal position towards a top wall 221 of the operation cavity 21 within the operation cavity 21. A height of the operation cavity 21 should be larger than a height of the shuttle 40, so that when a downwardly force is pressed on the top push-button 30, the shuttle 40 is driven downwardly by the transport rod 50 to a lower position towards a bottom wall 222 of the operation cavity 21.

According to the preferred embodiment, the top push-button 30 has a first axial hole 31 centrally provided at a bottom portion 32 thereof. The axial passage 22 is coaxially aligned with the first axial hole 31 of the top push-button 30 and the second axial hole 41 of the shuttle 40. The first end 51 of the transport rod 50 is affixed to the top push-button 30 by inserting in the first axial hole 31 of the top push-button 30 and the second end 52 is affixed to the shuttle 40 by inserting in a second axial hole 41 positioned on a top portion 42 of the shuttle 40.

There are a first, a second, a third, and a fourth contact plate for transferring the electrical signal. The first contact plate 71 is affixed on the top wall 221 of the operation cavity 21 of the switch body 20. The second contact plate 72 is affixed on top surface 43 of the shuttle 40. Therefore when the shuttle 40 is maintained in the upper position within the operation cavity 40, the first contact plate 71 and the second contact plate 72 are normally in electrically contact. The third contact plate 73 is affixed on a bottom surface 44 of the shuttle 40. The fourth contact plate 74 is affixed on the bottom wall 222 of the operation cavity 21 of the switch body 20. Therefore, when the shuttle 40 is selectively pressed by the push-button 30 and the transport rod 50 to the lower position, the third contact plate 73 and the fourth contact plate 74 are in electrical contact.

A length of the transport rod 50 is greater than a length of the axial passage 22 plus a length of the shuttle 40, so that a distance D is defined between the third contact plate 73 and the fourth contact plate 74. It is worth to mention that, a distance between the push-button 30 and the top end of the switch body 20 must be at least equal to the distance D.

A connection wire 75 such as a 22 GA. wire is glued to a front surface 40A of the shuttle 40. When the momentary switch of the present invention is equipped with a debouncer, such as a 74LS00 debouncer shown in FIG. 5. The connection wire 75 is also connected by a first (#30) wrap wire which is soldered to a pin 7 (ground) of the debouncer. The first contact plate 71 is connected by a second (#30) wrap wire which is soldered to a pin 5 of the debouncer. The fourth contact plate 74 is connected by a third (#30) wrap wire which is soldered to a pin 1 of the debouncer.

The first and the second contact plate 71, 72 are always in normal contact due to the pressure apply by the spring 60. When an external force is applied by the user to the top push-button 30 to give out order, the pushing force would compress the spring 60, thus the transport rod 50 would go down, and the second contact plate 72 would release from the first contact plate 71. As the top push-button 30 is pushed down, the shuttle 40 move downwardly, and the third contact plate 73 is driven to the lower position where the third contact plate 73 is in contact with the fourth contact plate 74 to give out a signal. As the user release the top push-button 30, the shuttle 40 would move back to its the original upper position, where the first contact plate 71 is in contact with the second contact plate 72.

Figure 5:
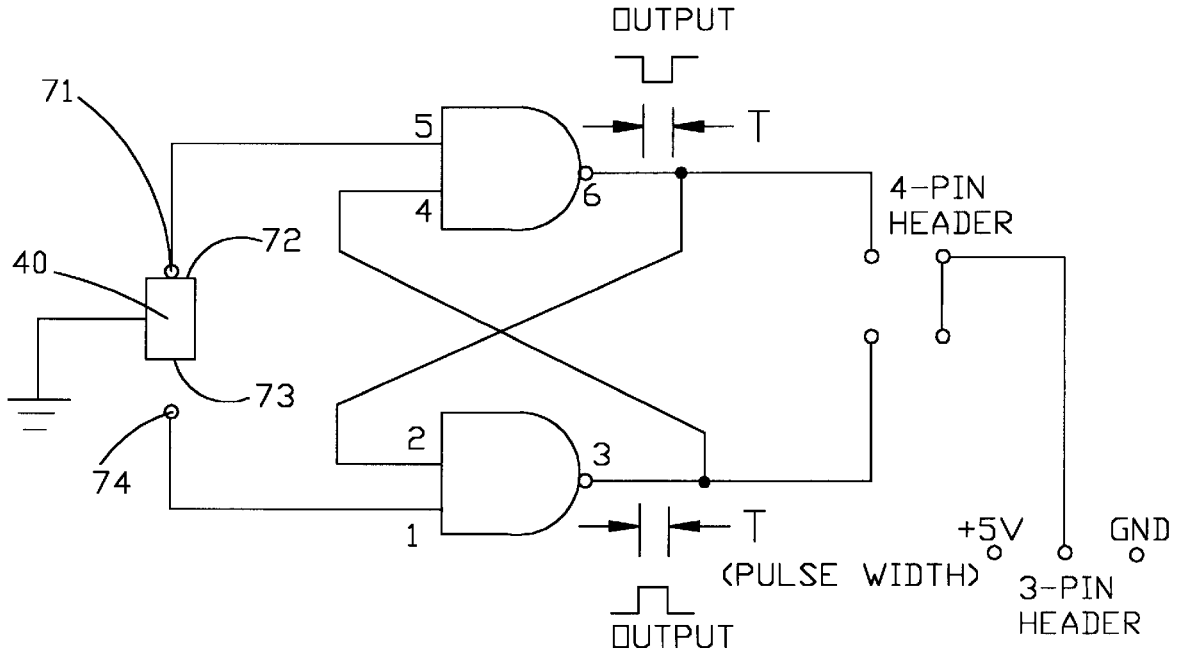
FIG. 5 is a diagrammatic electrical circuitry between the 74LS00 debouncer circuit and the momentary switch according to the above preferred embodiment of the present invention.

Referring to FIG. 5 of the drawing, according to the NAND logic gate truth table, a pin 6 and a pin 2 are high because a pin 5 is in contact to ground (low) by the 22 G.A. connection wire 75 provided on the front surface 40A of the shuttle 40. Floating TTL input is seen as high by TTL gates, so a pin 1 is also high. When the pin 6 is high, a pin 3 is low because the pin 2 and the pin 1 are high. The first time when the top push-button 30 is pushed down and contacts with the pin 1, the pin 1 goes low and the pin 3 goes high. Then the pin 6 goes low because the pins 3 and 4 are high, and the pin 5 (floating) is high because of the low state at the pin 6 and the pin 2. The pin 3 keeps high, ignoring the bounces at the pin 1 when the top push-button 30 is released. The spring expanding force provided by the spring 60 pushes the shuttle 40 to leave the pin 1 and go back to be in contact with the pin 5. At this moment, the pin 5 bounces low and high for a few milliseconds. The first time when the pin 5 goes low, the pin 6 goes high and the pin 3 goes back to low because both the pin 2 and the pin 1 (floating) are high. Because of the low state at the pins 3 and 4, the pin 6 keeps high, disregarding the bounces at the pin 5.

I claim:

1. A momentary switch, comprising a push-button;

a shuttle;

a switch body which has an operation cavity formed at a predetermined position to receive said shuttle therein and an axial passage extended from a top end of said switch body to said operation cavity, and that said shuttle which is smaller in size than said operation cavity of said switch body is positioned within said operation cavity, a bottom end of said axial passage reducing a diameter thereof to just slightly larger than said transport rod to form a shoulder rim;

a transport rod and a spring looping around said transport rod, wherein said transport rod which is adjustably inserted in said axial passage of said switch body along with said spring has a first end extended upwardly out of said top end of said switch body to connect with said top push-button and a second end extended downwardly into said operation cavity to connect with said shuttle, said spring being extended between said top push-button and said shoulder rim so as to upwardly press said shuttle to remain in an upper normal position towards a top wall of said operation cavity within said operation cavity, and that a height of said operation cavity is larger than a height of said shuttle, so that when a downwardly force is pressed on said top push-button, said shuttle is driven downwardly by said transport rod to a lower position towards a bottom wall of said operation cavity; and a first, a second, a third, and a fourth contact plate for transferring electrical signals, wherein said first contact plate is affixed on said top wall of said operation cavity of said switch body and said second contact plate is affixed on a top surface of said shuttle, so that when said shuttle is maintained in said upper position within said operation cavity, said first contact plate and said second contact plate are normally in electrically contact, and that said third contact plate is affixed on a bottom surface of said shuttle and said fourth contact plate is affixed on said bottom wall of said operation cavity of said switch body, so that when said shuttle is selectively pressed by said push-button and said transport rod to said lower position, said third contact plate and said fourth contact plate are in electrical contact.

2. A momentary switch, as recited in claim 1, wherein a length of said transport rod is greater than a length of said axial passage plus a length of said shuttle, so that a distance D is defined between said third contact plate and said fourth contact plate, and that another distance L between said push-button and said top end of said switch body is at least equal to said distance D.

3. A momentary switch, as recited in claim 1, further comprising a base plate to which said switch body is mounted thereon.

4. A momentary switch, as recited in claim 1, wherein said top push-button has a first axial hole centrally provided at a bottom portion thereof, said axial passage is coaxially aligned with said first axial hole of said top push-button and said second axial hole of said shuttle, said first end of said transport rod being affixed to said top push-button by inserting in said first axial hole of said top push-button and said second end being affixed to said shuttle by inserting in a second axial hole positioned on a top portion of said shuttle.

5. A momentary switch, as recited in claim 2, wherein said top push-button has a first axial hole centrally provided at a bottom portion thereof, said axial passage is coaxially aligned with said first axial hole of said top push-button and said second axial hole of said shuttle, said first end of said transport rod being affixed to said top push-button by inserting in said first axial hole of said top push-button and said second end being affixed to said shuttle by inserting in a second axial hole positioned on a top portion of said shuttle.

6. A momentary switch, as recited in claim 3, wherein said top push-button has a first axial hole centrally provided at a bottom portion thereof, said axial passage is coaxially aligned with said first axial hole of said top push-button and said second axial hole of said shuttle, said first end of said transport rod being affixed to said top push-button by inserting in said first axial hole of said top push-button and said second end being affixed to said shuttle by inserting in a second axial hole positioned on a top portion of said shuttle.

7. A momentary switch, as recited in claim 1, further comprising a connection wire glued to a front surface of said shuttle, and that said momentary switch is equipped with a debouncer, wherein said connection wire is connected by a first wrap wire which is soldered to a pin 7 of said debouncer, said first contact plate being connected by a second wrap wire which is soldered to a pin 5 of said debouncer, said fourth contact plate being connected by a third wrap wire which is soldered to a pin 1 of said debouncer.

8. A momentary switch, as recited in claim 4, further comprising a connection wire glued to a front surface of said shuttle, and that said momentary switch is equipped with a debouncer, wherein said connection wire is connected by a first wrap wire which is soldered to a pin 7 of said debouncer, said first contact plate being connected by a second wrap wire which is soldered to a pin 5 of said debouncer, said fourth contact plate being connected by a third wrap wire which is soldered to a pin 1 of said debouncer.

9. A momentary switch, as recited in claim 5, further comprising a connection wire glued to a front surface of said shuttle, and that said momentary switch is equipped with a debouncer, wherein said connection wire is connected by a first wrap wire which is soldered to a pin 7 of said debouncer, said first contact plate being connected by a second wrap wire which is soldered to a pin 5 of said debouncer, said fourth contact plate being connected by a third wrap wire which is soldered to a pin 1 of said debouncer.

10. A momentary switch, as recited in claim 6, further comprising a connection wire glued to a front surface of said shuttle, and that said momentary switch is equipped with a debouncer, wherein said connection wire is connected by a first wrap wire which is soldered to a pin 7 of said debouncer, said first contact plate being connected by a second wrap wire which is soldered to a pin 5 of said debouncer, said fourth contact plate being connected by a third wrap wire which is soldered to a pin 1 of said debouncer.

11. A momentary switch, as recited in claim 7, wherein a pin 6 and a pin 2 of said debouncer are high because the pin 5 is in contact to ground by said connection wire provided on said front surface of said shuttle, and that a floating TTL is input high by TTL gates, so that the pin 1 is also high, and that when said pin 6 is high, a pin 3 is low because said pin 2 and said pin 1 are high, and that a first time when said top push-button pushed down and contacts with said pin 1, said pin 1 goes low and said pin 3 goes high, and then said pin 6 goes low because said pins 3 and 4 are high, and that said pin 5 is high because of a low state at said pin 6 and said pin 2, and that said pin 3 keeps high, ignoring bounces at said pin 1 when said top push-button is released, and that a spring expanding force provided by said spring pushes said shuttle to leave said pin 1 and go back to be in contact with said pin 5, so that at this moment, said pin 5 bounces low and high for a few milliseconds, and that a first time when said pin 5 goes low, said pin 6 goes high and said pin 3 goes back to low because both said pin 2 and said pin 1 are high, because of said low state at said pins 3 and 4, said pin 6 keeps high, disregarding said bounces at said pin 5.

12. A momentary switch, as recited in claim 8, wherein a pin 6 and a pin 2 of said debouncer are high because the pin 5 is in contact to ground by said connection wire provided on said front surface of said shuttle, and that a floating TTL is input high by TTL gates, so that the pin 1 is also high, and that when said pin 6 is high, a pin 3 is low because said pin 2 and said pin 1 are high, and that a first time when said top push-button pushed down and contacts with said pin 1, said pin 1 goes low and said pin 3 goes high, and then said pin 6 goes low because said pins 3 and 4 are high, and that said pin 5 is high because of a low state at said pin 6 and said pin 2, and that said pin 3 keeps high, ignoring bounces at said pin 1 when said top push-button is released, and that a spring expanding force provided by said spring pushes said shuttle to leave said pin 1 and go back to be in contact with said pin 5, so that at this moment said pin 5 bounces low and high for a few milliseconds, and that a first time when said pin 5 goes low, said pin 6 goes high and said pin 3 goes back to low because both said pin 2 and said pin 1 are high, because of said low state at said pins 3 and 4, said pin 6 keeps high, disregarding said bounces at said pin 5.

13. A momentary switch, as recited in claim 9, wherein a pin 6 and a pin 2 of said debouncer are high because the pin 5 is in contact to ground by said connection wire provided on said front surface of said shuttle, and that a floating TTL is input high by TTL gates, so that the pin 1 is also high, and that when said pin 6 is high, a pin 3 is low because said pin 2 and said pin 1 are high, and that a first time when said top push-button pushed down and contacts with said pin 1, said pin 1 goes low and said pin 3 goes high, and then said pin 6 goes low because said pins 3 and 4 are high, and that said pin 5 is high because of a low state at said pin 6 and said pin 2, and that said pin 3 keeps high, ignoring bounces at said pin 1 when said top push-button is released, and that a spring expanding force provided by said spring pushes said shuffle to leave said pin 1 and go back to be in contact with said pin 5, so that at this moment, said pin 5 bounces low and high for a few milliseconds, and that a first time when said pin 5 goes low, said pin 6 goes high and said pin 3 goes back to low because both said pin 2 and said pin 1 are high, because of said low state at said pins 3 and 4, said pin 6 keeps high, disregarding said bounces at said pin 5.

14. A momentary switch, as recited in claim 10, wherein a pin 6 and a pin 2 of said debouncer are high because the pin 5 is in contact to ground by said connection wire provided on said front surface of said shuttle, and that a floating TTL is input high by TTL gates, so that the pin 1 is also high, and that when said pin 6 is high, a pin 3 is low because said pin 2 and said pin 1 are high, and that a first time when said top push-button pushed down and contacts with said pin 1, said pin 1 goes low and said pin 3 goes high, and then said pin 6 goes low because said pins 3 and 4 are high, and that said pin 5 is high because of a low state at said pin 6 and said pin 2, and that said pin 3 keeps high, ignoring bounces at said pin 1 when said top push-button is released, and that a spring expanding force provided by said spring pushes said shuffle to leave said pin 1 and go back to be in contact with said pin 5, so that at this moment, said pin 5 bounces low and high for a few milliseconds, and that a first time when said pin 5 goes low, said pin 6 goes high and said pin 3 goes back to low because both said pin 2 and said pin 1 are high, because of said low state at said pins 3 and 4, said pin 6 keeps high, disregarding said bounces at said pin 5.

* * * * *